US006198903B1

(12) United States Patent
Benedict

(10) Patent No.: US 6,198,903 B1
(45) Date of Patent: Mar. 6, 2001

(54) REPRODUCTION MACHINE HAVING A STALLING PREVENTING TRANSFER STATION SHEET PLACEMENT ASSEMBLY

(75) Inventor: Lawrence R. Benedict, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/561,223

(22) Filed: Apr. 28, 2000

(51) Int. Cl.[7] ..... G03G 15/00; G03G 15/16
(52) U.S. Cl. ..... 399/388; 399/66; 399/316
(58) Field of Search ..... 399/296, 388, 399/390, 66, 316

(56) References Cited

U.S. PATENT DOCUMENTS 4,926,219 * 5/1990 Hirasawa et al. ..... 399/316 X
5,268,724 * 12/1993 Koizumi et al. ..... 399/388 X
5,311,267 * 5/1994 Bean ..... 399/316 X
5,633,703 * 5/1997 Takenouchi et al. ..... 399/66 X
5,678,122 * 10/1997 Gross ..... 399/388 X
5,737,681 * 4/1998 Hyakutake et al. ..... 399/388
5,835,832 * 11/1998 Rimai et al. ..... 399/296 X
5,920,746 * 7/1999 Thomas et al. ..... 399/316 X
6,055,409 * 4/2000 Richards et al. ..... 399/388

* cited by examiner

*Primary Examiner*—Susan S. Y. Lee
(74) *Attorney, Agent, or Firm*—Tallam I. Nguti

(57) ABSTRACT

An electrostatographic reproduction machine includes a stalling preventing copy sheet placement assembly for effectively placing copy sheets of varying sheet stiffness at its image transfer station. The stalling preventing copy sheet placement assembly includes a first baffle and a second baffle defining a pre-transfer sheet path for guiding a copy sheet towards placement against the photoreceptor at the transfer station, and a rotatable, low drag sheet placement roller located at an exit end of the pre-transfer sheet path, and electrically biased, for controlling and driving the copy sheet out of the pre-transfer sheet path into placement against the photoreceptor, thereby reducing drag on the copy sheet and preventing sheet stalling of even relatively high stiffness copy sheets at the transfer station.

7 Claims, 3 Drawing Sheets

REPRODUCTION MACHINE HAVING A STALLING PREVENTING TRANSFER STATION SHEET PLACEMENT ASSEMBLY

BACKGROUND OF THE INVENTION

This invention relates to electrostatographic reproduction machines, and more particularly to such a reproduction machine having a sheet stalling preventing transfer station placement assembly for placing low stiffness and high stiffness sheets to the toner image transfer station at a common angle without sheet stalling and resulting image smearing.

In a typical electrophotographic printing process, a aphotoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member or photoreceptor. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules either to a donor roll or to a latent image on the photoreceptor. The toner attracted to a donor roll is then is copy sheet that must be fed and placed into contact with the photoreceptor. After such transfer, the toner particles are then heated by a fusing apparatus to permanently affix them to the copy sheet.

Because the copy can be one of a variety of such copy sheets which vary in thickness, weight and hence stiffness, feeding and placing copy sheets against the photoreceptor at the transfer station ordinarily is a difficult and problematic task. This is because relatively low stiffness copy sheets ordinarily require a steep contact angle with the photoreceptor in order to insure paper flatness against the photoreceptor as well as effective toner image transfer, while for similar flatness, relatively high stiffness copy sheets require a much lower contact angle. It has been found that the pre-transfer station nip assembly drive force that would ordinarily be required to bend the high stiffness copy sheet is so high that the copy sheet will tend to stall when it is released by the pre-transfer station nip assembly, thus resulting in copy sheet jams and causing image smear.

Thus high stiffness copy sheets cannot be effectively placed against the photoreceptor at the same high contact angle as low stiffness copy sheets. It is thus relatively difficult and costly to design transfer area effective and economical copy sheet forwarding and placement assemblies that can handle copy sheets of a wide range of stiffness without adjustment.

There is therefore a need for a reproduction machine having a sheet stalling preventing transfer station placement assembly for effectively placing low stiffness and high stiffness sheets to the toner image transfer station at a common angle without sheet stalling and resulting image smearing.

SUMMARY OF THE INVENTION

In accordance with the present invention, there is provided an electrostatographic reproduction machine for producing toner developed reproductions of images on copy sheets. The electrostatographic reproduction machine includes a stalling preventing copy sheet placement assembly for effectively placing copy sheets of varying sheet stiffness at its image transfer station. The stalling preventing copy sheet placement assembly includes a first baffle and a second baffle defining a pre-transfer sheet path for guiding a copy sheet towards placement against the photoreceptor at the transfer station, and a rotatable, low drag sheet placement roller located at an exit end of the pre-transfer sheet path, and electrically biased, for contacting and driving the copy sheet out of the pre-transfer sheet path into placement against the photoreceptor, thereby reducing drag on the copy sheet and preventing sheet stalling of even relatively high stiffness copy sheets at the transfer station.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
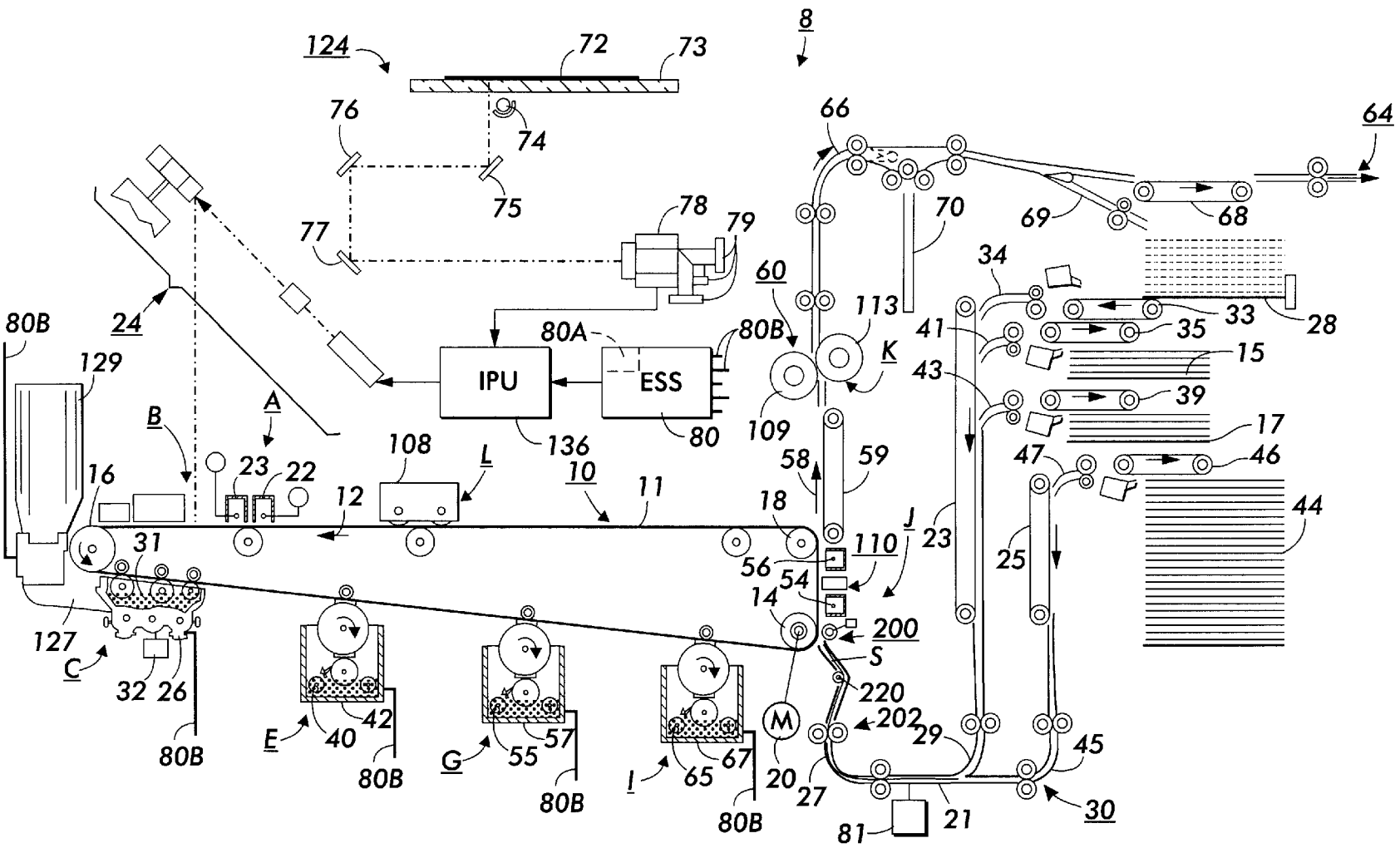
FIG. 1 is a schematic elevational view of an electrostatographic reproduction machine including the sheet stalling preventing transfer station placement assembly of the present invention.

Referring to FIG. 1, there is depicted an exemplary electrostatographic reproduction machine, such as a multipass color electrostatographic reproduction machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the selective spring loading, and driving of the low drag sheet placement roller of the present invention (to be described in detail below).

The ESS is preferably a self-contained, dedicated minicomputer having a central processor unit (CPU), electronic storage, and a display or user interface (UI). The ESS is the control system which with the help of sensors and connections 80B as well as a calculator 80A, reads, captures, prepares and manages the image data flow between IPU 136 and image input terminal 124. In addition, the ESS 80 is the main multi-tasking processor for operating and controlling all of the other machine subsystems and printing operations. These printing operations include imaging, development, sheet delivery and transfer, and particularly the effective placement of copy sheets of varying stiffness in accordance with the present invention. Such operations also include various functions associated with subsequent finishing processes. Some or all of these subsystems may have microcontrollers that communicate with the ESS 80.

The multipass color electrostatographic reproduction machine 8 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, in a first imaging pass, the photoreceptor 10 passes through charging station A where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station B. At imaging station B, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separation image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. A special feature of non-interactive development is that adding and admixing can continue even when development is disabled. Therefore the timing algorithm for the adding and admixing function can be independent of that for the development function, as long as admixing is enabled whenever development is required. The donor roller members of the unit 26 transport negatively charged black toner particles for example, to the latent image for development thereof which tones the particular (first) color separation image areas and leaves other areas untoned.

Power supply 32 electrically biases development unit 26. Development or application of the charged toner particles as above typically depletes the level and hence concentration of toner particles, at some rate, from developer material in the development unit 26. This is also true of the other development units (to be described below) of the machine 8.

Accordingly, different jobs of several documents being reproduced, will cause toner depletion at different rates depending on the sustained, copy sheet toner area coverage level of the images thereof being reproduced. In a machine using two component developer material as here, such depletion undesirably changes the concentration of such particles in the developer material. In order to maintain the concentration of toner particles within the developer material (in an attempt to insure the continued quality of subsequent images), the adding and admixing function of the development unit must be operating or turned "on" for some controlled period of time in order for the device 127 to replenish the development unit such as 26 with fresh toner particles from the source 129. Such fresh toner particles must then be admixed with the carrier particles in order to properly charge them triboeletrically.

On the second and subsequent passes of the multipass machine 8, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is-effected across a uniform development field.

Imaging device 24 is then used on the second and subsequent passes of the multipass machine 8, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station E, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 8, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station G. An example of a suitable third color toner is magenta. Suitable electrical biasing of the development unit 57 is provided by a power supply, not shown.

On the fourth pass of the multipass machine 8, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station 1. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member 50 negatively charges all toner particles to the required negative polarity to ensure proper subsequent transfer.

Since the machine 8 is a multicolor, multipass machine as described above, only one of the plurality of development units, 26, 42, 57 and 67 may have its development function turned "on" and operating during any one of the required number of passes, for a particular color separation image development. The remaining development units must thus have their development functions turned off.

Still referring to FIG. 1, during the exposure and development of the last color separation image, for example by the fourth development unit 67 a sheet of support material S is advanced towards a transfer station J by a sheet feeding apparatus 30. During simplex operation (single sided copy), a blank sheet S may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 may each hold a different sheet type, for example, sheets of varying thickness, weight and hence stiffness. The speed of the sheet S is adjusted at registration transport 21 so that the sheet arrives at transfer station J in synchronization with the composite multicolor image on the surface of photoconductive belt 10.

Registration transport 21 can receive a sheet S from either a vertical transport 23 or a high capacity tray transport 25 and moves the received sheet path 27 to a pre-transfer nip assembly 202, described further below. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet S from trays 15 and 17 to the vertical transport 23 by chutes 41 and 43. The high capacity tray transport 25 receives the sheet from tray 44 and guides it to the registration transport 21 via a lower baffle 45.

Figure 2:
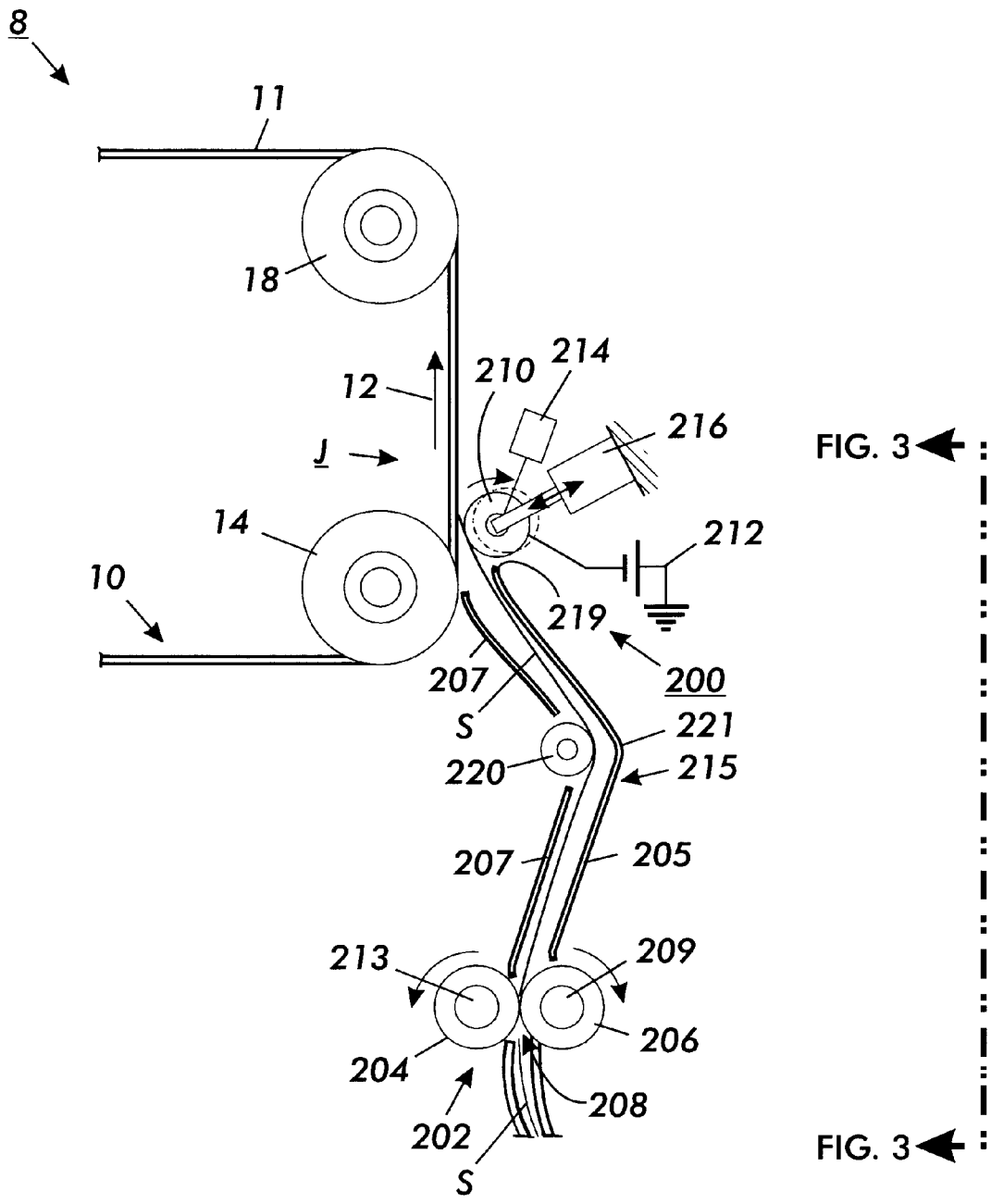
FIG. 2 is an enlarged portion of the machine of FIG. 1 show in more detail the sheet stalling preventing transfer station placement assembly of the present invention.
Figure 3:
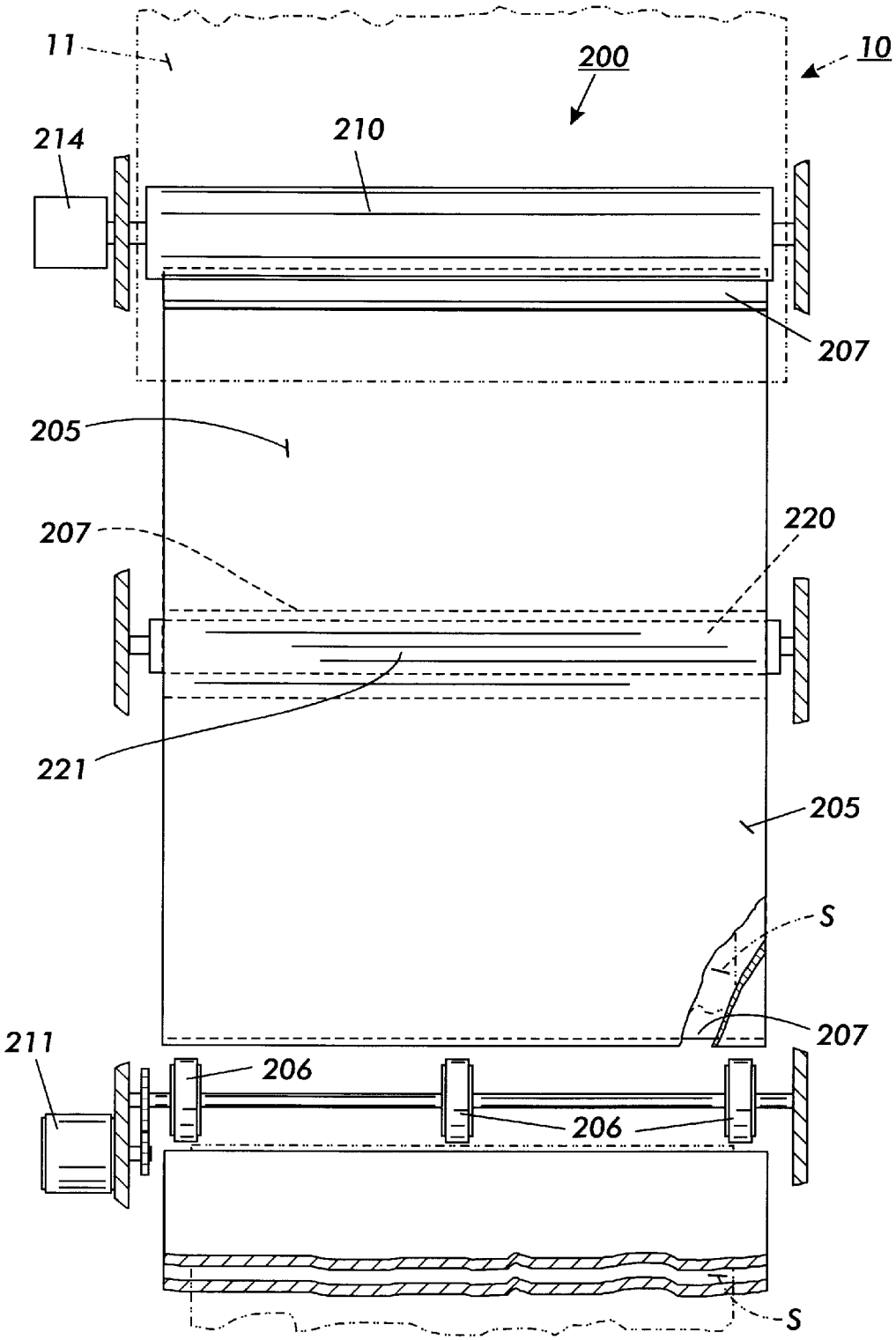
FIG. 3 is schematic view (as referenced in FIG. 2) of the sheet stalling preventing transfer station placement assembly of the present invention.

Referring now to FIGS. 1–3, the pre-transfer nip assembly 202 comprises a pair of shafts 209, 213 on each of which is mounted a set of two or more spaced apart disc rollers, 206, 204 respectively. As shown, each roller 204 forms a nip 208 with a corresponding roller 206 for forwarding a copy sheet S, towards the stalling preventing copy sheet placement assembly 200 of the present invention. As further shown (FIG. 3, the pre-transfer nip assembly 202 is driven by its own brushless DC motor 211. As driven and controlled via the ESS 80, the pre-transfer nip assembly serves to transport the sheet S from the registration assembly 21, as well as to make a final process direction registration correction, to match the speed of the sheet S to the photoreceptor speed, and to perform final side two trail edge registration.

As pointed out above, because the copy sheet S can be one of a variety of such copy sheets which vary in stiffness, feeding and placing copy sheets against the photoreceptor 10 at the transfer station J ordinarily is a difficult and problematic task. This is because relatively low stiffness copy sheets ordinarily require a steep contact angle with the photoreceptor in order to ensure sheet flatness against the photoreceptor, as well as, effective toner image transfer. For similar flatness and results, relatively high stiffness copy sheets require a much lower contact angle with the photoreceptor. It has been found that the drive force, (of the pre-transfer station nip assembly), that would ordinarily be required to bend the high stiffness copy sheet is so high that the copy sheet will tend to stall when it is released by the pre-transfer station nip assembly, thus resulting in copy sheet jams and causing image smear.

Thus in accordance with the present invention, and with reference to FIGS. 1–3, the machine 8 includes a stalling preventing copy sheet placement assembly 200 effectively placing copy sheets of varying sheet stiffness at the image transfer station J without sheet stalling and resulting image smearing. As illustrated, the stalling preventing copy sheet placement assembly 200 includes a first baffle 205 and a second baffle 207 as defining a pre-transfer sheet path 215 for guiding a copy sheet S towards placement against the photoreceptor 10 at the transfer station J. As shown, the sheet path 215 is curved so as to have an S-like shape for correct sheet placement against the photoreceptor surface. As such, the sheet path 215 includes a first bend 221 and a second bend at or near an exit end 219 that is adjacent the transfer station J.

The stalling preventing copy sheet placement assembly 200 also includes a rotatable, low drag sheet placement roller 210 that is long and cylindrical in shape, and may be tubular. Roller 210 is located at the exit end 219 of the pre-transfer sheet path 215 for controlling and driving the copy sheet S out of the pre-transfer sheet path, and into placement against the photoreceptor 10 at high contact angles. This, thereby reduces drag on the copy sheet S and preventing stalling of even relatively high stiffness copy sheets at the transfer station J. The stalling preventing copy sheet placement assembly 200 also includes an electrical potential source 212, such as a D.C. voltage, for biasing the low drag sheet placement roller 210 so as to help reduce transfer bias leakage to the roller 210.

As illustrated, the stalling preventing copy sheet placement assembly 200 may also include a rotatable, low drag sheet forwarding roller 220 that is long and cylindrical in shape, and may be tubular. Roller 220 is located at the first bend 221 of the pre-transfer sheet path 215 for contacting and driving the copy sheet S from the pre-transfer nip assembly 202 towards the rotatable sheet placement roller 210.

As clearly shown in FIG. 3, in order to ensure sheet flatness, the rotatable low drag sheet placement roller 210, as contrasted with the pre-transfer nip rollers 204, 206, is a full length solid roller for making continuous contact with the full width of a copy sheet S across the pre-transfer sheet path 215. Similarly, the rotatable sheet forwarding roller 220 is preferably also a solid full-width contact roller that makes continuous contact with the full width of a sheet S across the pre-transfer sheet path 215. Each roller 210, 220 can be mounted so as to be freely rotatable, or alternatively so as to be driveable.

A drive means such as a motor 214 may also be connected to the low drag sheet placement roller 210 and to the controller ESS 80, for moving the low drag sheet placement roller 210, selectively, to drive the forwarded copy sheet S for placement at transfer station J. Preferably, the drive means 214 is controlled to selectively move the low drag sheet placement roller 210(it even helps light weight papers when driven). As shown, the stalling preventing copy sheet placement assembly 200 may further include a spring member 216 that is coupled to the low drag sheet placement roller 210 for lightly loading and urging the low drag sheet placement roller 210, selectively, into contact and driving engagement with the copy sheet S. The spring 216 will actually hold the roll 210 against a fixed mechanical stop (not shown) which gives the roll a constant gap to the Photoreceptor belt. The roll will only move up and out when excessive forces are applied to it by high stiffness paper. Spring loading against the sheet S when provided is preferably maintained only until the lead edge of the copy sheet S is fully placed and tacked to the photoreceptor at the transfer station J.

One advantage of the present invention is that it opens up the operating window for effectively placing different types of copy sheets at the transfer station J by eliminating the stalling problem associated with placement of relatively high stiffness sheets at relatively high contact angles. This is accomplished by adding rotatable rollers 210,220 at high friction points along the pre-transfer sheet path 215. These rollers effectively reduce drag on high stiffness sheets of paper to a level sufficient to prevent paper stalling and the resulting image smear. As such both high and low stiffness sheets of paper can be run at the same contact angle without such stalling. An added feature is the rolls also prevent coating damage and marking of high gloss coated stocks.

Referring again and in particular to FIG. 1, transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10. After transfer, the sheet continues to move, in the direction of arrow 58, onto a conveyor 59 that advances the sheet to fusing station K.

Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed at cleaning station L using a cleaning brush structure contained in a unit 108.

As can be seen, there has been provided an electrostatographic reproduction machine includes a stalling preventing copy sheet placement assembly for effectively placing copy sheets of varying sheet stiffness at its image transfer station. The stalling preventing copy sheet placement assembly includes a first baffle and a second baffle defining a pre-transfer sheet path for guiding a copy sheet towards placement against the photoreceptor at the transfer station, and a rotatable, low drag sheet placement roller located at an exit end of the pre-transfer sheet path, and electrically biased, for contacting and driving the copy sheet out of the pre-transfer sheet path into placement against the photoreceptor, thereby reducing drag on the copy sheet and preventing sheet stalling of even relatively high stiffness copy sheets at the transfer station.

While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. An electrostatographic reproduction machine for producing toner developed reproductions of images on copy sheets, the electrostatographic reproduction machine comprising:

(a) a machine frame;

(b) electrostatographic assemblies mounted to said frame and including a moveable photoreceptor and an image transfer station, for forming and transferring a toner image onto a copy sheet;

(c) copy sheet supply assemblies mounted to said frame for supplying and feeding copy sheets of varying sheet stiffness for placement at said image transfer station; and (d) a stalling preventing copy sheet placement assembly mounted to said frame for effectively placing copy sheets of varying sheet stiffness at said image transfer station, said stalling preventing copy sheet placement assembly including:

(i) a first baffle and a second baffle defining a pre-transfer sheet path for guiding a copy sheet towards placement against said photoreceptor at said transfer station, said sheet path having an exit end adjacent said transfer station;

(ii) a rotatable, low drag sheet placement roller located at said exit end of said pre-transfer sheet path for controlling and driving the copy sheet out of said pre-transfer sheet path and into placement against said photoreceptor, thereby reducing drag on the copy sheet and preventing stalling of even relatively high stiffness copy sheets at said transfer station; and (iii) an electrical potential source biasing said low drag sheet placement roller for preventing transfer bias leakage.

2. The electrostatographic reproduction machine of claim 1, wherein said stalling preventing copy sheet placement assembly includes a drive means connected to said low drag sheet placement roller for moving said low drag sheet placement roller to drive the forwarded copy sheet.

3. The electrostatographic reproduction machine of claim 1, wherein said stalling preventing copy sheet placement assembly includes a spring member coupled to said low drag sheet placement roller for loading and urging said low drag sheet placement roller into contact and driving engagement with the copy sheet.

4. The electrostatographic reproduction machine of claim 1, wherein said pre-transfer sheet path is curved.

5. The electrostatographic reproduction machine of claim 1, wherein said rotatable, low drag sheet placement roller is a full length solid roller for making continuous contact with a full width of a copy sheet across said pre-transfer sheet path.

6. The electrostatographic reproduction machine of claim 2, wherein said drive means connected to said low drag sheet placement roller is controlled to selectively move said low drag sheet placement roller only when driving and placing relatively high stiffness copy sheets.

7. The electrostatographic reproduction machine of claim 4, wherein said pre-transfer sheet path is curved and has an S-like shape.

* * * * *